US006089137A

United States Patent [19]

Lee

[11] Patent Number: 6,089,137

[45] Date of Patent: Jul. 18, 2000

[54] PAPER PUNCH

[76] Inventor: Cheng-Ho Lee, No. 74, Paokao Rd., Hsintien City, Taipei Hsien, Taiwan

[21] Appl. No.: 09/360,613

[22] Filed: Jul. 26, 1999

[30] Foreign Application Priority Data

Jun. 10, 1999 [TW] Taiwan ..... 88209520

[51] Int. Cl.[7] ..... B26F 1/02

[52] U.S. Cl. ..... 83/621; 83/633; 83/686; 83/588; 30/358

[58] Field of Search ..... 83/633, 686, 628, 83/588, 167, 621; 30/278, 358, 363, 364

[56] References Cited

U.S. PATENT DOCUMENTS

| | | | |
|---|---|---|---|
| 2,275,525 | 3/1942 | Halmrast | 83/621 |
| 3,673,901 | 7/1972 | Vinson | 83/621 |
| 3,785,233 | 1/1974 | Robinson | 83/633 |
| 4,036,088 | 7/1977 | Ruskin | 83/633 |
| 4,713,995 | 12/1987 | Davi | 83/167 |
| 4,753,010 | 6/1988 | Franovich | 83/621 |
| 5,495,671 | 3/1996 | Shun-Yi | 30/358 |
| 5,601,006 | 2/1997 | Quinn et al. | 83/588 |
| 5,697,278 | 12/1997 | Shun-Yi | 83/588 |
| 5,749,278 | 5/1998 | Lee et al. . | |
| 6,000,139 | 12/1999 | Chan | 30/358 |

*Primary Examiner*—Kenneth E. Peterson
*Assistant Examiner*—Sean Pryor
*Attorney, Agent, or Firm*—Dellett and Walters

[57] ABSTRACT

A paper punch has an inner punch and an outer punch movably received with respect to each other. The outer punch has a first contour punch so as to be able to punch a hole in a piece of paper with the same contour as that of the first contour punch, and the inner punch has a second contour punch so as to punch a small hole in a piece of paper with the same contour as that of the second contour punch. Because the second contour punch moves first and the first and the second contour punches are placed concentrically, a piece of paper is then able to be punched twice by the first and the second contour punches to have an attractive shape.

18 Claims, 8 Drawing Sheets

PAPER PUNCH

BACKGROUND OF THE INVENTION

1. Field of the Invention

The present invention relates to a paper punch, and more particularly to a paper punch which is able to punch a hole out a piece of paper with a particular contour and continuously punch out openings on paper with that particular contour.

2. Description of Related Art

A paper punch is used to punch out holes in a piece of paper or a stack of suitable material. Although different paper punches are available, the basic structure of a paper punch is is recognizable in virtually all variations, and includes a base, at least one punch rod housing integrally formed on the base, a handle pivotally connected with the punch rod housing and at least one punch rod movably received in the punch rod housing and operatively connected with the handle. A paper slot is defined between the base and the punch rod housing and a hole is defined in the base to correspond to the punch rod, such that when the punch rod is driven by the handle and moved in the punch rod housing, the punch rod is able to extend through the paper slot and into the hole in the base. When a piece of paper is placed in the paper slot and the handle is operated by a user, the punch rod will extend through the hole in the base and the piece of paper will then be punched by the punch rod and at least one hole is accordingly defined in the piece of paper.

Another type of punch is disclosed in U.S. Pat. No. 5,749,278. The principle of the punch is basically the same as the one described above. However, it has at least one punch rod configured to have a particular shape and a hole whose shape is defined to mate with the shape of the punch rod, such that when the punch rod is activated by the handle, the punch rod will punch out a special pattern on a piece of paper. Therefore, a user is able to use this kind of paper punch to punch out decorative patterns with different materials. It is noted that the paper punches described above are able to punch out holes on a piece of paper or any other suitable materials, but they still have shortcomings. The shortcomings include the following:

1. Only simple and dull shapes can be defined in a piece of paper:

By using the single or multiple punch rods, only simple and dull openings can be defined in a piece of paper. This kind of punch cannot punch out a rabbit with a pair of eyes or a mouth for instance.

2. Economically inefficient:

Every time the user wants to change the shape of the punched out piece of paper, the user has to buy a new punch, to get a punch rod with a different configuration, which is quite a waste to the user.

Based on the above discussion, it is noted that the conventional paper punch needs improvements to overcome the shortcomings.

Therefore, it is an objective of the invention to provide an improved paper punch to mitigate and/or obviate the aforementioned problems.

SUMMARY OF THE INVENTION

The main objective of the invention is to provide an improved paper punch that is able to punch a hole out a piece of paper with a particular shape and having at least one hole punched therein.

Another objective of the invention is to provide a paper punch which is able to change the shape punched in a piece of paper so as to increase the practical usage and attraction of the punch.

Other objects, advantages and novel features of the invention will become more apparent from the following detailed description when taken in conjunction with the accompanying drawings.

DETAILED DESCRIPTION OF PREFERRED EMBODIMENT

Figure 1:
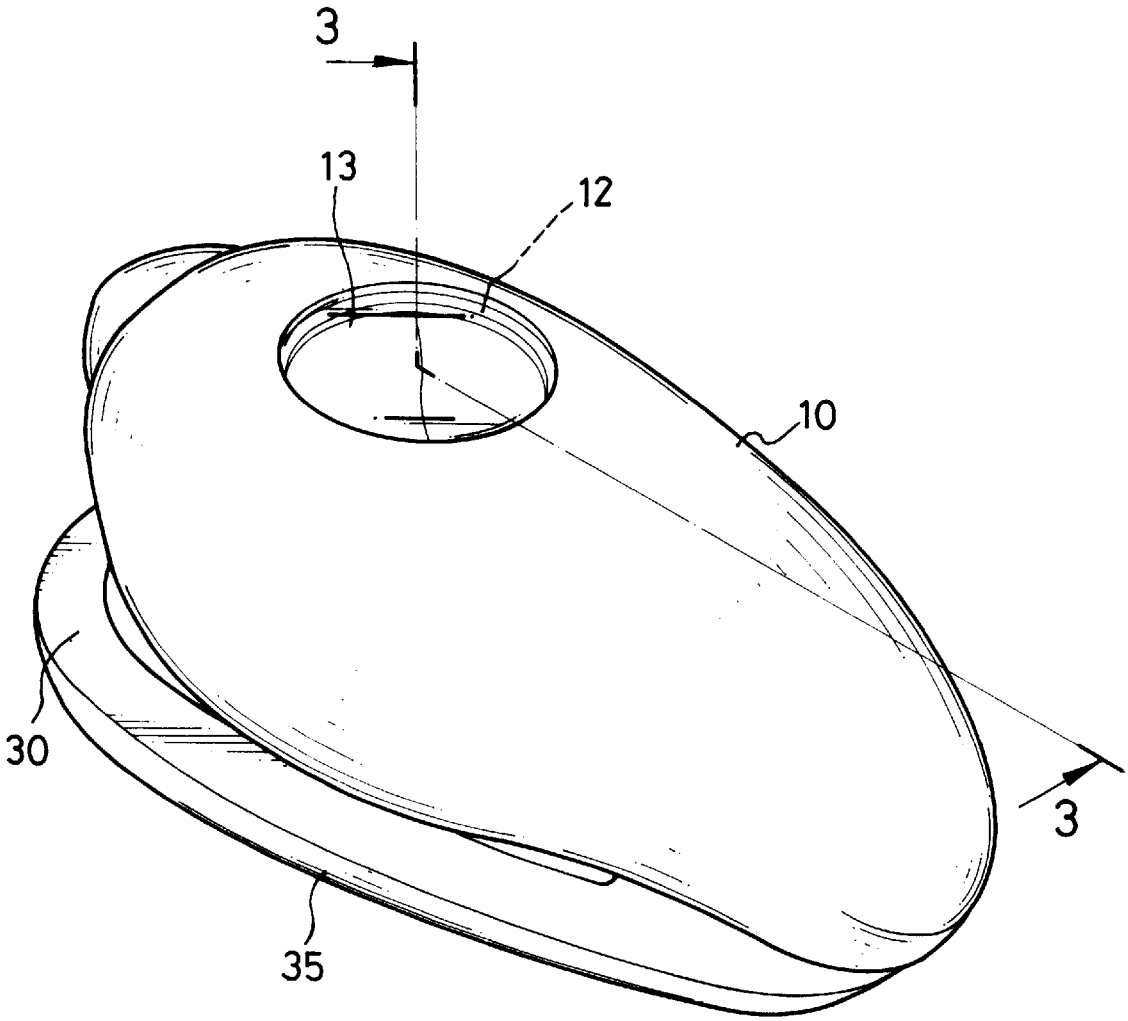
FIG. 1 is a perspective view of a preferred embodiment of a paper punch in accordance with the present invention.
Figure 2:
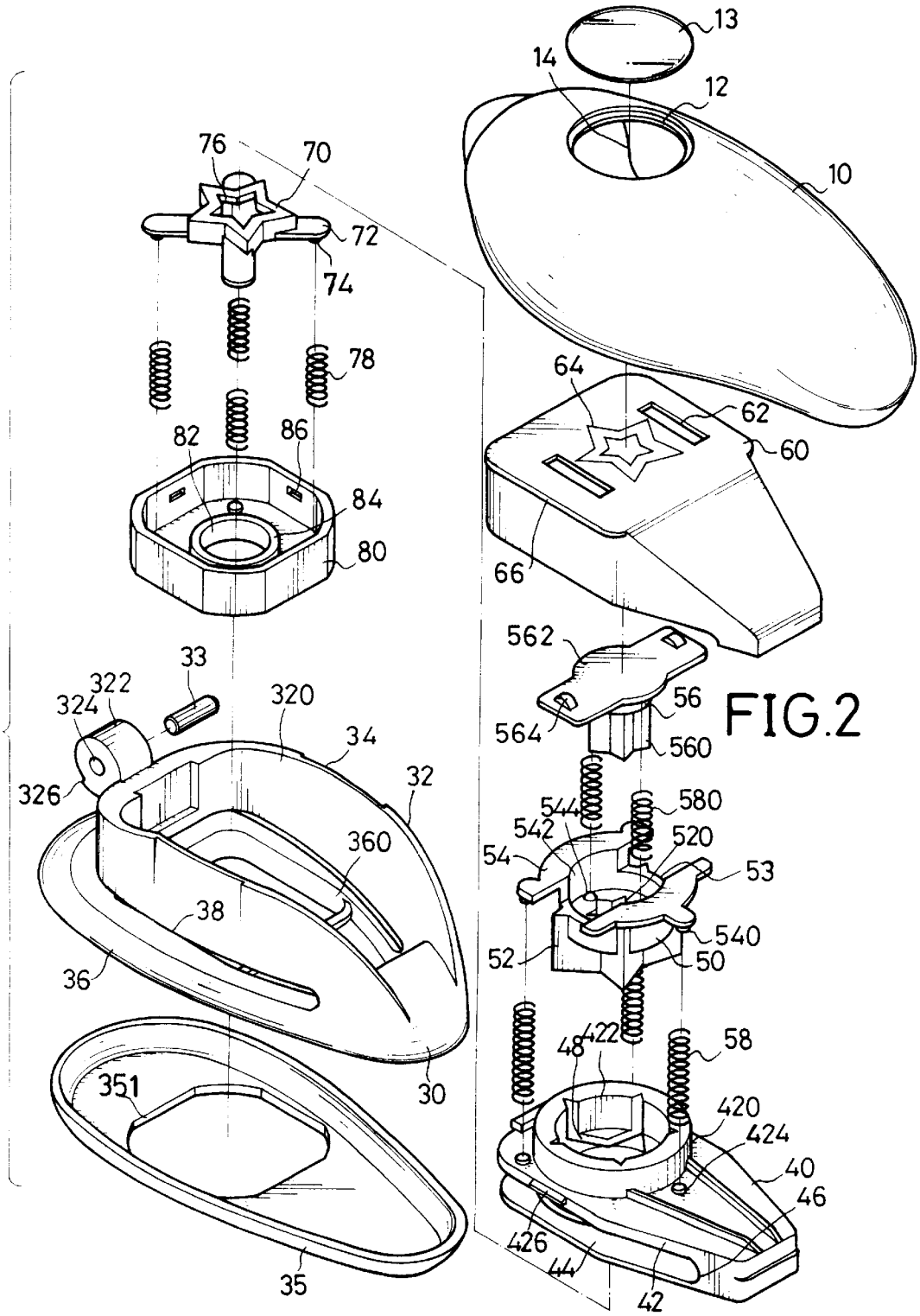
FIG. 2 is an exploded perspective view of the paper punch in FIG. 1.

Referring to FIGS. 1 and 2, the punch in accordance with the present invention has a handle (10) with a through hole (12) defined in the top face, a transparent plate (13) detachably mounted on and covering the through hole (12), at least two arcuate plates (14) integrally formed under the handle (10), a base (30) pivotally connected with the handle (10) and a bottom cover (35), which has a first hole (351) defined therethrough, detachably connected under the base (30). The base (30) further has a substantially circular wall (32), a housing (320) defined by the wall (32), a pivot (322) integrally formed on the outer periphery of the wall (32), a bottom (36) integrally formed with the wall (32) and a paper slot (38) defined between the bottom (36) and the wall (32).

Figure 3:
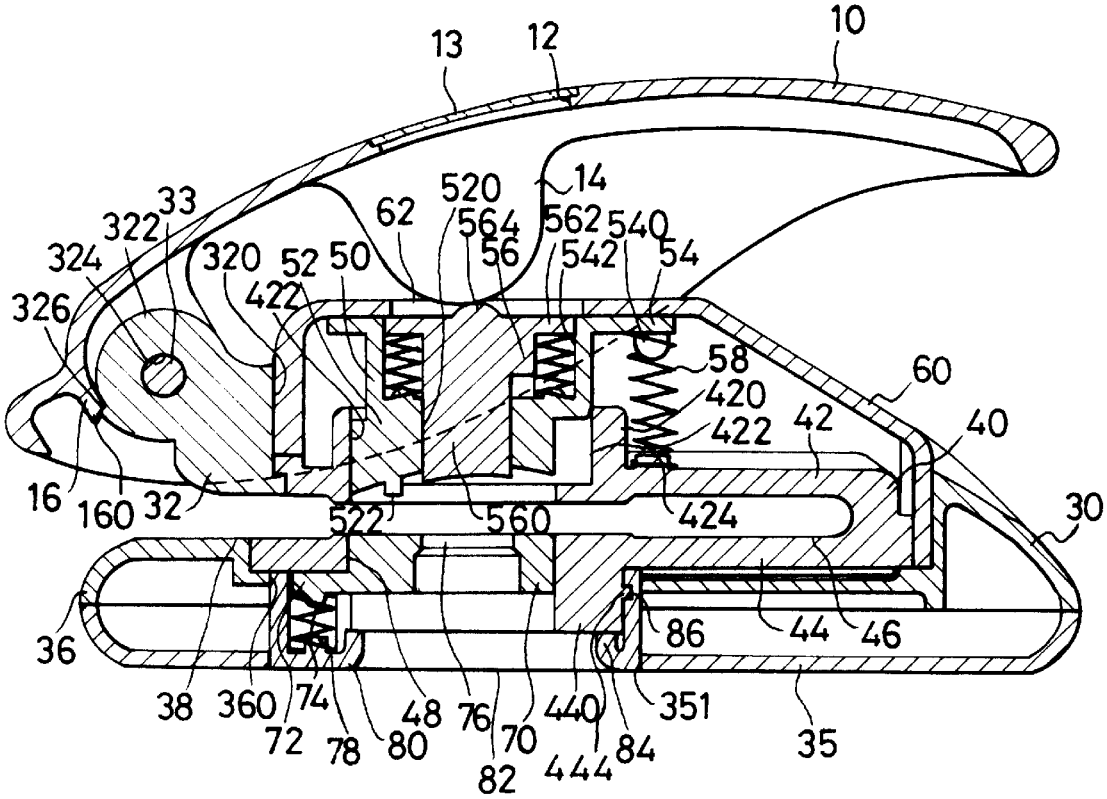
FIG. 3 is a side cross sectional plan view of the paper punch in FIG. 1 along line 3—3.

A pivot pin hole (324) is defined through the pivot (322) to allow a pin (33) to extend through the pivot pin hole (324) to pivotally connected the handle (10) to the pivot (322). A lip (326) is formed on the outer periphery of the pivot (322) to limit the upward travel of the handle (10) when the face (160) of a flexible extension (16) integrally formed under the handle (10) abuts the lip (326), as shown in FIG. 3.

The bottom (36) has a second hole (360) defined to communicate with the housing (320) and the first hole (351) of the bottom cover (35)

Figure 4:
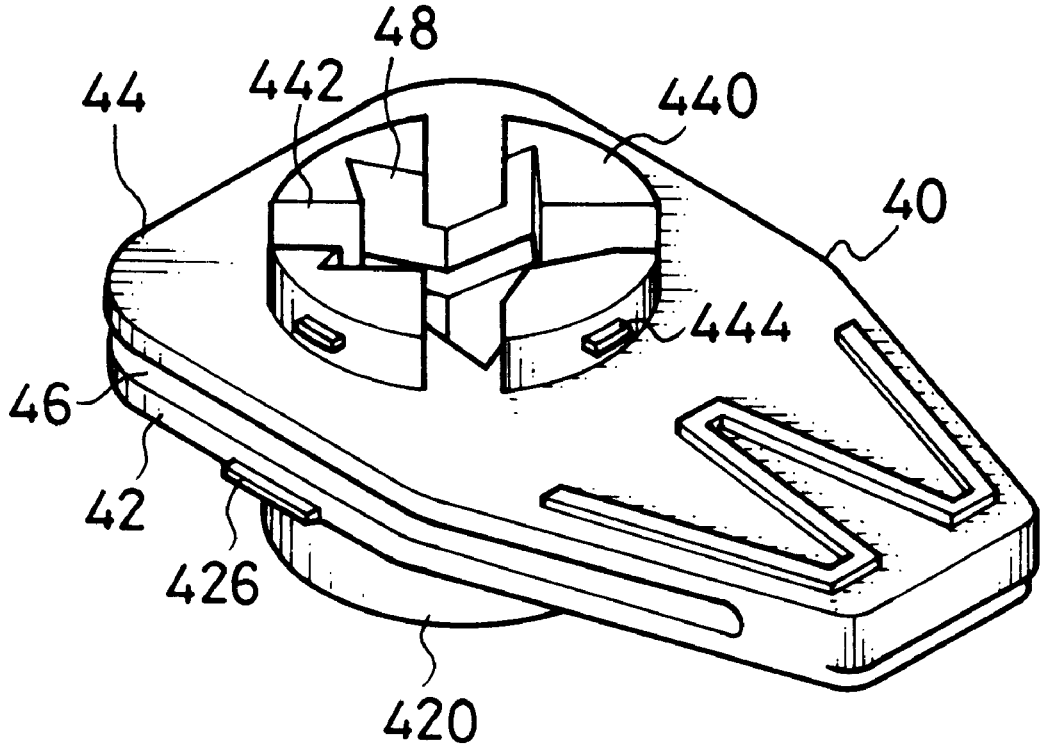
FIG. 4 is a perspective view of the bottom of a core used in the punch in FIG. 1.

The paper punch further has a core (40) mounted in the housing (320) of the base (30) with an upper plate (42), a lower plate (44) integrally formed with the upper plate (42) and a paper slot (46) defined between the upper plate (42) and the lower plate (44). The upper plate (42) has a seat (420) integrally formed with and extending from the top of the upper plate (42), a large housing (422) defined in the seat (420), multiple first bosses (424) formed around the seat (420) and a wing (426) formed on each side of the upper plate (42) to hold the core (40) upward in the housing (320) of the base (30). Referring to FIG. 4, the lower plate (44) has multiple protrusions (440) integrally extending downward, multiple cutouts (442) defined among the protrusions (440), a tongue (444) formed on the outside of each of the protrusions (440) and multiple outer channels (48) defined to communicate with the large housing (422) and the cutouts (442).

An outer punch (50) is movably received in the large housing (422) of the core (40) and has a first contour punch (52) integrally formed therewith, an inner channel (520) defined in the first contour punch (52), a pair of plates (54) being parallel with each other and formed on top thereof, a channel (53) defined between the pair of plates (54) and communicating with the inner channel (520), multiple outer bosses (540) integrally formed under each of the plates (54) that correspond to the bosses (424) of the core (40) so that multiple first springs (58) are able to be compressibly received between the bosses (424) and the outer bosses (540), a small housing (542) defined to communicate with the channel (53) and the inner channel (520), multiple inner bosses (544) formed on the bottom face defining the small housing (542) and an inner punch (56) which is movably received in the small housing (542) and has a second contour punch (560) integrally formed therewith and movably extended through the inner channel (520) of the outer punch (50), an elongated plate (562) formed on top of the second contour punch (560) and movably received in the channel (53) and at least one extrusion (564) formed to correspond to the arcuate plate (14) under the handle (10). At least two second springs (580) are compressed between the elongated plate (562) and the inner bosses of the outer punch (50), such that the inner punch (56) is able to be movably received in the small housing (542), and because of the first springs (58), the outer punch (50) is able to be movably received in the large housing (422).

A cover (60) is placed on top of the upper plate (42) of the core (40) and encloses the outer punch (50) and the inner punch (56). The cover (60) has at least one slit (62) defined to allow the arcuate plate (14) of the handle (10) to extend therethrough to engage with the extrusion (564) of the inner punch (56) and an index mark (64) formed to correspond to the through hole (12) of the handle (10), such that a user is able to identify the shape of the piece of paper which is about to be punched out by the inner punch (56) and the outer punch (50).

The paper punch has a abutting member (70) configured to have the same shape as that of the outer channel (48) of the core (40) thereby allowing the abutting member (70) to be snugly received in the outer channel (48). The abutting member (70) has multiple extensions (72) extending outward from the bottom thereof and each corresponding to one of the cutouts (442), such that when the abutting member (70) is received in the outer channel (48) of the core (40), the extensions (72) are received in the cutouts (442). The abutting member has a positioning boss (74) formed under each of the extensions (72) and an inner hole (76) defined to correspond to the shape of the second contour punch (560).

A supporting member (80) detachably connects with the core (40) and encloses the abutting member (70) therebetween. The supporting member (80) has an exit (82) defined to correspond to the inner hole (76) of the abutting member (70), a guide flange (84) formed around the face defining the exit (82) to limit the movement of the abutting member (70) and a plurality of notches (86) defined to correspond to the tongues (444) on the core (40) so as to detachably connect the supporting member (80) to the core (40). Furthermore, multiple recovery springs (78) are received between the abutting member (70) and the supporting member (80) to provide the abutting member (70) a recovery force when the abutting member (70) is pushed down by the first contour punch (52) of the outer punch (50).

Referring to FIG. 3, when the paper punch is assembled, the base (30) and the bottom cover (35) are securely connected to allow the first hole (351) to correspond to the second hole (360). After the base (30) and the bottom cover (35) are assembled, the handle (10) is pivotally connected with the base (30) by means of the engagement between the pivot (322), the pivot pin (33) and the flexible extension (16). Due to the elasticity of the flexible extension (16), the abutment of the face (160) of the flexible extension (16) on the lip (326) is easily disengaged when opening the handle (10) if required. When assembling the core (40) and the outer punch (50), the first springs (58) are first positioned between the bosses (424) and the outer bosses (540), such that the outer punch (50) is supported by the first springs (58). Thereafter, the second springs (580) are positioned between the inner bosses (544) of the outer punch (50) and the elongate plate (562). After the core (40), the outer punch (50) and the inner punch (56) are assembled together and the core (40) is snugly received in the housing (320) of the base (30), the supporting member (80) receiving the recovery springs (78) and the abutting member (70) therein is able to be detachably connected with the core (40) be means of the engagement between the tongues (444) and the recesses (86). As seen in FIG. 3, a safety boss (522) is formed on the bottom of the first contour punch (52), such that when the outer punch (50) is moved toward the abutting member (70), the safety boss (522) is able to prevent the first contour punch (52) and the abutting member (70) from engaging so as to protect the first contour punch (52) from damage.

Figure 5:
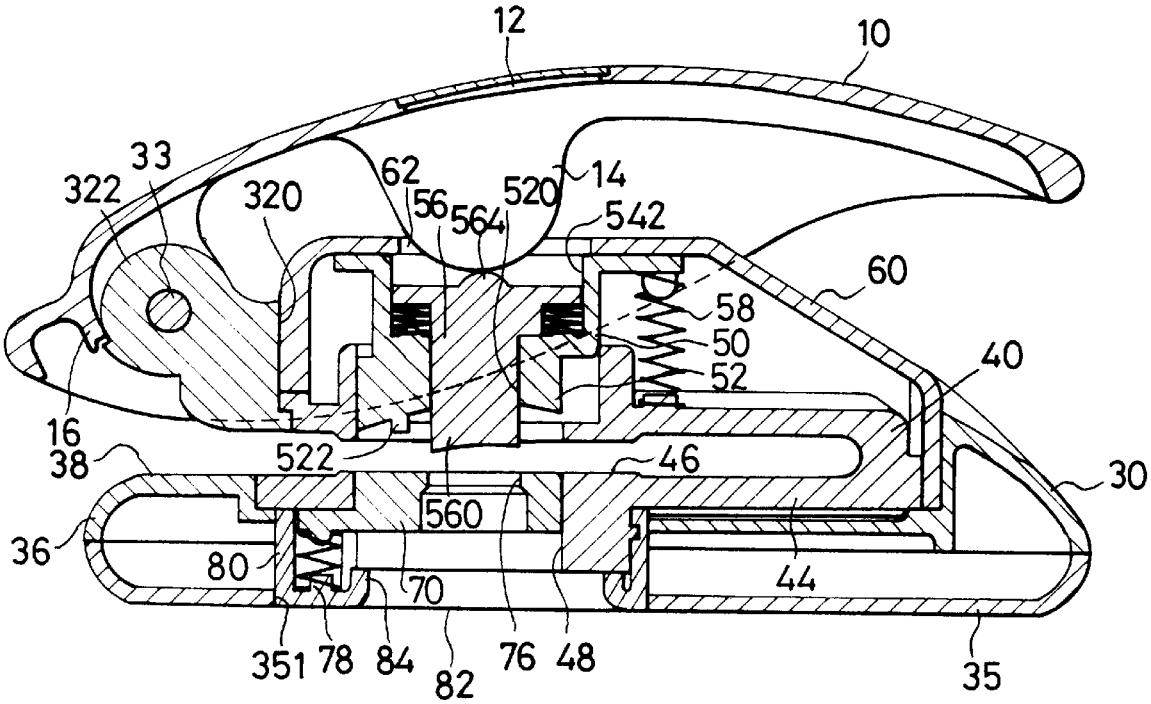
FIGS. 5 and 6 are side cross sectional plan views of the paper punch in FIG. 1 in operation.

Referring to FIG. 5, when the punch of the invention is assembled, the arcuate plate (14) of the handle (10) extends through the slit (62) of the cover (60) to contact the extrusion (564) of the second contour punch (560) and the second contour punch (560) is held on top of the outer punch (50) by the second springs (580). The first springs (58) are received between the bosses (424) of the core (40) and the outer bosses (540) of the core (40), such that the outer punch (50) is able to be movably received in the large housing (422) of the core (40). When the outer punch (50) is received in the large housing (422) of the core (40), the first contour punch (52) is able to extend through the large housing (422) and then abut the face of the abutting member (70) by the safety boss (522). Furthermore, when the core (40) is received in the housing (320) of the base (30), the paper slot (46) of the core (40) corresponds to the paper slot (38) of the base (30).

Figure 6:
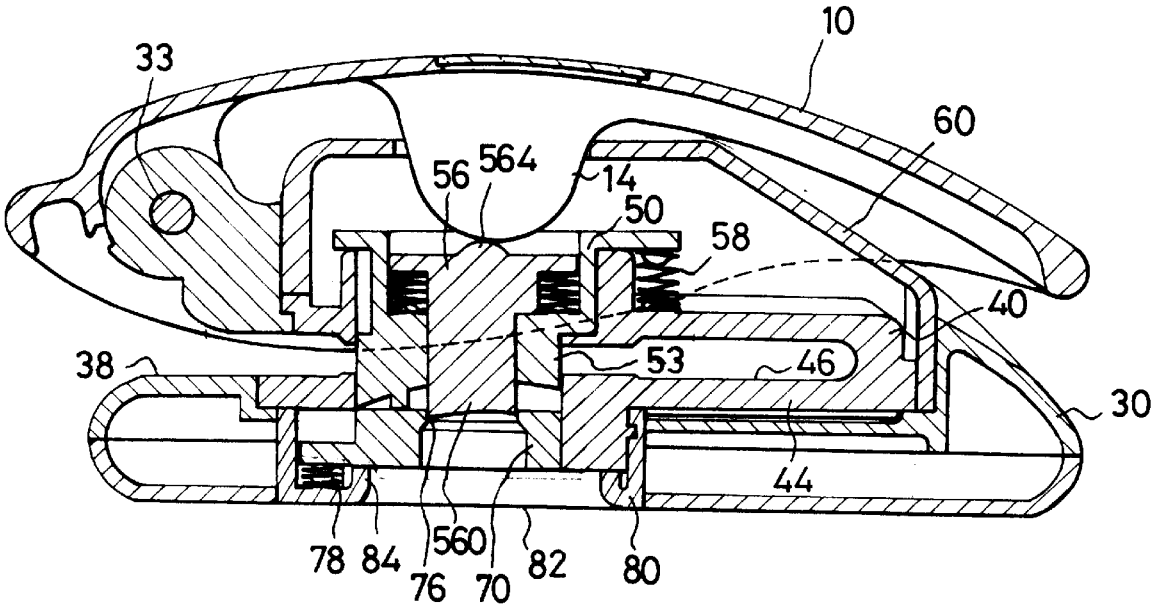

Referring to FIG. 6, when the handle (10) is pressed, the arcuate plate (14) forces the inner punch (56) to move in the small housing ((542) of the outer punch (50), and because of the channel (53), the second contour punch (560) extends through the inner channel (520), the large housing (422), the outer channel (48) and into the inner hole (76) of the abutting member (70). If a piece of paper is placed in the paper slots (46, 38), a piece of paper in the shape of the inner hole (76) will be cut out by the second contour punch (560) and discarded from the exit (82) of the supporting member (80) and further out from the first and second holes (360, 351). While the inner punch (56) is moving in the small housing (542) and the inner channel (520) and continues to move toward the large housing (422), the second springs (580) are compressed. When the second springs (580) are not able to be compressed any more, the inner punch (56) will drive the outer punch (50) to move therewith, such that the first springs (58) are compressed accordingly. After a piece of paper is or punched out by the second contour punch (560) of the inner punch (56), the outer punch (50) is driven to move in the outer channel (48). After a hole is punched out the piece of paper by the second contour punch (560), the piece of paper still rests in the paper slots (46,38). Therefore, when the outer punch (50) continues to move, the piece of paper will be punched on the same spot where the second contour punch (560) punched for the second time. The only difference is that the first contour punch (52) is larger in size than that of the second contour punch (560), such that a piece of paper whose outer contour is the same as that of the first contour punch (52) and inner contour is the same as that of the second contour punch (560).

Figure 7:
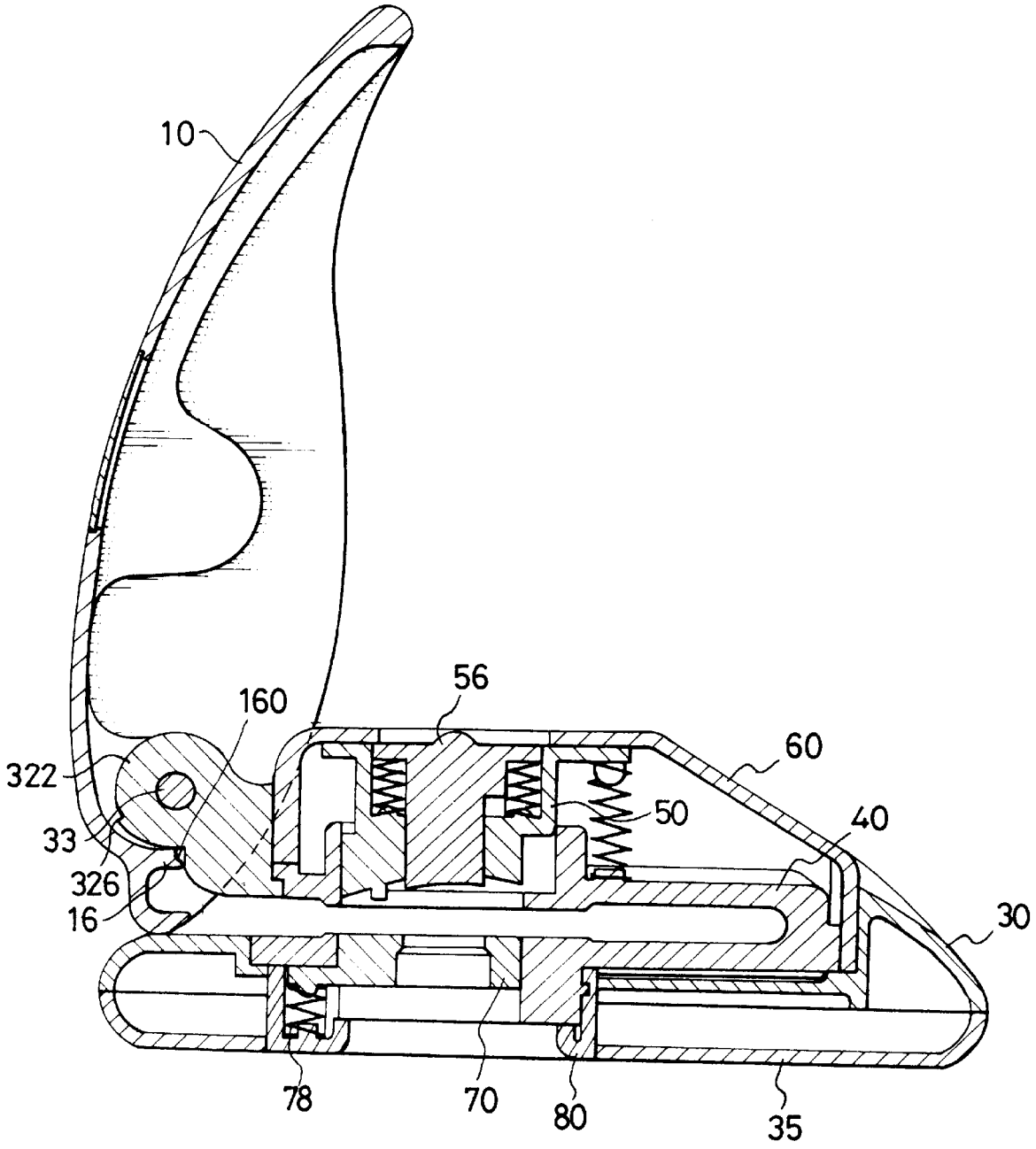
FIG. 7 is a side cross sectional plan view of the paper punch in FIG. 1 with the handle lifted.
Figure 8:
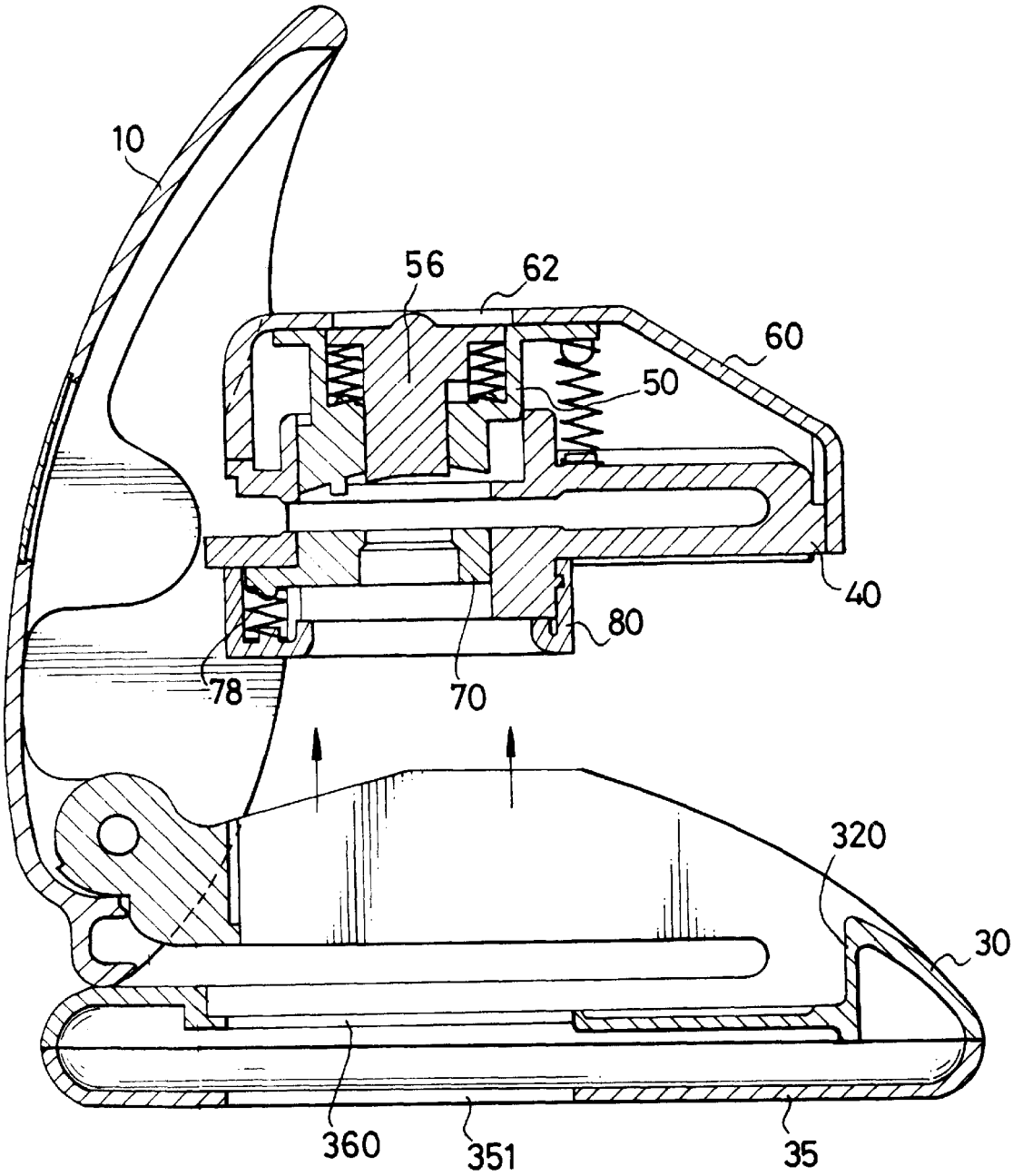
FIG. 8 is a side cross sectional plan view of the punch in FIG. 1 with the core lifted upward from the base.

The user is able to see what shape is going to be punched out by the inner punch (56) and the outer punch (50) from the transparent plate (13) mounted on top of the through hole (12) of the handle (10). However, if the shape of what is going to be punched out is not what the user likes, the user may lift the handle (10) first by forcing the face (160) of the flexible extension (16) to cross over the lip (326). Referring to FIGS. 7 and 8, when the handle (10) is fully lifted upward, the user is able to readily raise the cover (60), the inner punch (56), the outer punch (50), the core (40), the abutting member (70) and the supporting member (80) from the housing (320) of the base (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A paper punch comprising:

a handle (10);

a base (30) pivotally connected with the handle (10) and having a housing (320), a first hole (360) defined to communicate with the housing (320), a paper slot (38) defined to communicate with the first hole (360) and a bottom cover (35) connected with the base (30) and provided with a second hole (351) in communication with the first hole (360);

a core (40) snugly received in the housing (320) and having a large housing (422), a paper slot (46) corresponding to the paper slot (38), an outer channel (48) defined to communicate with the large housing (422) and multiple protrusions (440) extending out from a bottom thereof;

an outer punch (50) movably received in the large housing (422) and having a first contour punch (52) extendably and movably received in the large housing (422), an inner channel (520) defined to communicate with the outer channel (48) and a small housing (542); an inner punch (56) contacted by the handle (10) and movably received in the small housing (542) and having a second contour punch (560) extendably and movably received in the small housing (542), the inner channel (520) and the outer channel (48);

an abutting member (70) movably received in the outer channel (48) of the core (40) and having an inner hole (76) corresponding to the outer channel (48) and the inner channel (520) thereby allowing the second contour punch (560) to extend therethrough;

a supporting member (80) detachably connected with the core (40) and having the abutting member (70) received therebetween; and the second contour punch (560) being able to extend through the small housing (542), the inner channel (520), the large housing (422), the outer channel (48), the paper slot (46) and into the inner hole (76) while the first contour punch (52) being able to extend into the paper slot (46).

2. The paper punch as claimed in claim 1, wherein the handle (10) further has a through hole (12) and a transparent plate (13) mounted in the through hole (12) so as to facilitate observation by the user.

3. The paper punch as claimed in claim 1 further comprising a cover (60) snugly placed on top of the core (40) and having at least one slit (62) defined therethrough so as to facilitate the engagement between the handle (10) and the inner punch (56).

4. The paper punch as claimed in claim 3, wherein the handle further has an arcuate plate (14) formed to extend through the slit (62) to contact with the inner punch (56).

5. The paper punch as claimed in claim 4, wherein the inner punch (56) further has at least one extrusions (564) formed on top thereof so as that the arcuate plate (14) is able to extend through the slit (62) to engage with the extrusions (564).

6. The paper punch as claimed in claim 1, wherein the handle (10) has a flexible extension (16) and the base (30) has a pivot (322) formed to be pivotally connected with the handle (10) and having a lip (326) peripherally formed therewith, such that a face (160) of the flexible extension (16) is able to abut to the lip (326).

7. The paper punch as claimed in claim 6, wherein the pivot (322) has a pivot pin hole (324) defined therethrough so as to allow a pin (33) to pivotally connect therewith by extending through the handle (10) and into the pivot pin hole (324).

8. The paper punch as claimed in claim 1, wherein the extrusion (564) of the inner punch (56) is formed on an elongate plate (562) and the outer punch (50) has a channel (53) defined to communicate with the small housing (542), such that the elongate plate (562) of the inner punch (56) is able to be movably received in the small housing (542).

9. The paper punch as claimed in claim 1, wherein multiple first springs (580) are received between the inner punch (56) and the small housing (542) of the outer punch (50) so as to enable the inner punch (56) to move in the small housing (542); and wherein multiple second springs (58) are received between the outer punch (50) and the core (40), such that the first contour punch (52) is able to move in the large housing (422) with respect to the core (40).

10. The paper punch as claimed in claim 9, wherein multiple inner bosses (544) are formed in the small housing (542) so as to position the first springs (580) in place.

11. The paper punch as claimed in claim 10, wherein multiple outer bosses (540) are formed on an underside of the outer punch (50), and a plurality of bosses (424) are formed on the core (40), wherein each of the outer bosses (540) correspond to one of the bosses (424) of the core (40), so that the second springs (58) are able to be positioned in place between the outer bosses (540) and the bosses (424) when placed between the core (40) and the outer punch (50).

12. The paper punch as claimed in claim 1, wherein the core (40) further has multiple cutouts (442) defined to communicate with the outer channel (48);

wherein the abutting member has a plurality of extensions (72) extending out from a bottom thereof and received in the cutouts (442) of the core (40).

13. The paper punch as claimed in claim 1, wherein multiple recovery springs (78) are received between the abutting member (70) and the supporting member (80) so as to facilitate the movement of the abutting member (70) with respect to the supporting member (80).

14. The paper punch as claimed in claim 1, wherein the supporting member (80) has a guide flange (84) formed to correspond to the abutting member (70) so as to limit the movement of the abutting member (70).

15. The paper punch as claimed in claim 14, wherein the supporting member (80) has an exit (82) defined to correspond to and communicate with the inner hole (76) of the abutting member (70).

16. The paper punch as claimed in claim 1, wherein the shape of the inner hole (76) of the abutting member (70) is the same as the contour of the second contour (560).

17. The paper punch as claimed in claim 1, wherein the shape of the outer channel (48) is the same as the contour of the first contour punch (52).

18. The paper punch as claimed in claim 3, wherein an index mark (64) indicating the shape of the second contour punch (560) and the first contour punch (52) respectively is formed on the cover (60) so as to facilitate observation of the shapes of the first contour punch (52) and the second contour punch (560).

* * * * *